United States Patent [19]

Lingl

[11] 3,976,417

[45] Aug. 4, 1976

[54] APPARATUS FOR THE PRODUCTION OF CERAMIC PLATES WITH ORNAMENTAL SHAPES

[75] Inventor: Hans Lingl, Neu-Ulm-Ludwigsfeld, Germany

[73] Assignee: Lingl Corporation, Paris, Tenn.

[22] Filed: Mar. 10, 1975

[21] Appl. No.: 557,222

Related U.S. Application Data

[62] Division of Ser. No. 478,036, June 10, 1974.

[30] Foreign Application Priority Data

Aug. 17, 1973 Germany ..... 2341631

[52] U.S. Cl. ..... 425/307; 425/324 R; 425/455 R

[51] Int. Cl.[2] ..... B28B 11/14

[58] Field of Search ..... 425/307, 297, 299, 305, 425/324 R, 455; 264/151, 60

[56] References Cited

UNITED STATES PATENTS

| | | | |
|---|---|---|---|
| 1,234,098 | 7/1917 | Koch | 264/151 X |
| 1,613,567 | 1/1927 | Ogden | 425/297 X |
| 2,907,129 | 10/1959 | Bedell | 264/60 X |
| 3,412,427 | 11/1968 | Flusfeder et al. | 425/455 X |
| 3,429,002 | 2/1969 | Saffron | 425/297 |
| 3,454,694 | 7/1969 | Delaire et al. | 264/151 X |
| 3,461,196 | 8/1969 | Bowles | 264/151 X |
| 3,635,632 | 1/1972 | Shaw et al. | 425/297 |

*Primary Examiner*—Robert L. Spicer, Jr.
*Attorney, Agent, or Firm*—Cushman, Darby & Cushman

[57] ABSTRACT

The invention relates to apparatus for producing ceramic tiles with ornamental shapes from clay emerging from an extrusion press. Shaped punching tools are disposed on either side of the clay column from which the tiles are to be formed, and are moved on a carriage in the direction of the moving column at a speed corresponding to the speed of the moving column. Supports hold the clay while it is being punched. A drive system such as a fluid actuated drive system moves the punching tools, and the drive system is selectively actuated in response to movement of the carriage. Cutting wires sever each column section acted upon by the punching tools from the rest of the column.

10 Claims, 6 Drawing Figures

APPARATUS FOR THE PRODUCTION OF CERAMIC PLATES WITH ORNAMENTAL SHAPES

This is a division of application Ser. No. 478,036 filed June 10, 1974.

BACKGROUND AND SUMMARY OF THE INVENTION

The invention relates to apparatus for producing ceramic tiles with ornamental shapes from clay of other nonmetallic minerals emerging from an extrusion press. The clay column emerging from such a press, which may be solid or have longitudinal elongated apertures in the middle thereof, (hereinafter referred to as grooves) is scored vertically to be separated into pairs of tiles after firing. In the past, rectangular or square grooved tiles have been produced by running knives, e.g. cutting wires, perpendicular to the direction of movement of a grooved clay column emerging from an extrusion press, but ornamental tiles have only been produced by dry-pressing in molds, or by single tile columns extruded while flat, pressed through openings with ornamental shapes, and dried and fired while flat. Producing tiles by the extrusion press process with double tile columns is economically superior to molding, however, and according to the teachings of the present invention, ornamental tiles can be so produced with the resulting economic advantages. Also, when tiles are produced by this method they can be dried standing up and can be fired while piled up on stacks with a subsequent reduction in the number of supports required, and reduced firing time. The apparatus according to the teachings of the present invention may be easily installed in existing facilities producing rectangular grooved tiles by the extrusion press method, thus readily extending the capabilities of such facilities.

According to the teachings of the present invention, a clay column with tile faces oriented horizontally emerging from an extrusion press is acted upon by punching tools moving perpendicular to the direction of movement of the clay column to approximately the middle of the clay column. The punching tools are formed in the shape desired for the ornamental tiles that will be produced thereby. The punching tools are mounted on a carriage that moves at approximately the same speed as the clay column in the same direction as the column. Cushioned holders are disposed around the punching members for holding the clay column in position when acted upon by the punching tools to prevent breakage of the tiles being formed. Means associated with the holders prevent the holders from sticking to the tiles and lubricate the punching tools. The drive for the punching tools may be a fluid actuated or otherwise powered lever system. Fluid may be selectively supplied to the fluid drive of the punching tools by a valve actuated by the movement of the carriage.

It is the primary object of the present invention to provide apparatus for producing ornamental tiles from a scored clay column, producing one or more pairs of tiles simultaneously by the extrusion press process. This and other objects of the invention will become clear from an inspection of the detailed description of the invention and from the appended claims.

DETAILED DESCRIPTION OF THE INVENTION

Figure 1:
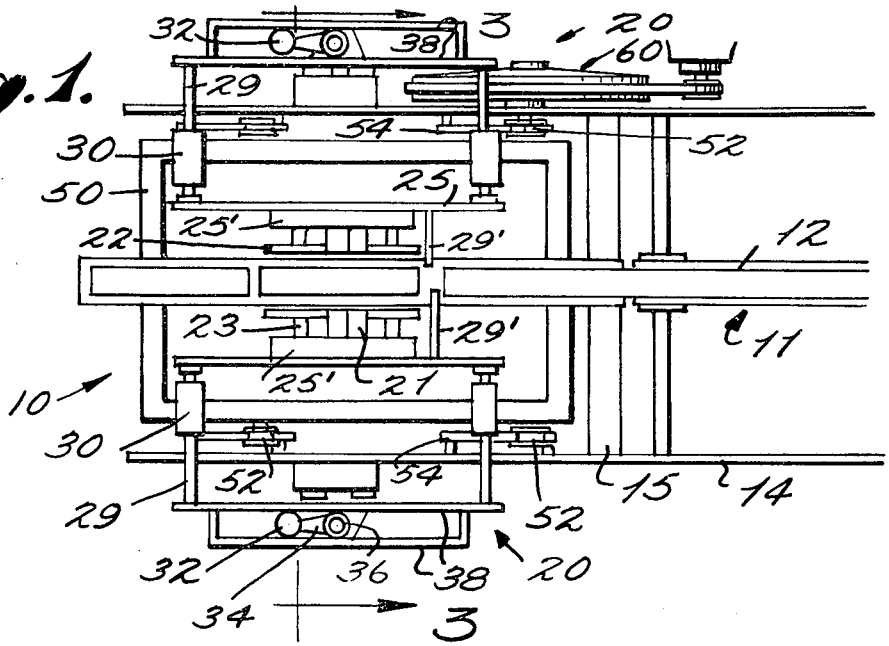
FIG. 1 is a top plan view of an exemplary apparatus for forming ornamental tiles according to the teachings of the present invention.

Apparatus for producing ornamental tiles according to the teachings of the present invention is shown generally at 10 in FIG. 1. A conveyor belt 11 carries a grooved clay column 12 from an extrusion press through the apparatus 10 and on to drying and/or firing means for finishing the tiles formed. The apparatus 10 has a frame 14 and various cross supports, shown at 15, 16 and 17 in FIG. 2.

Figure 3:
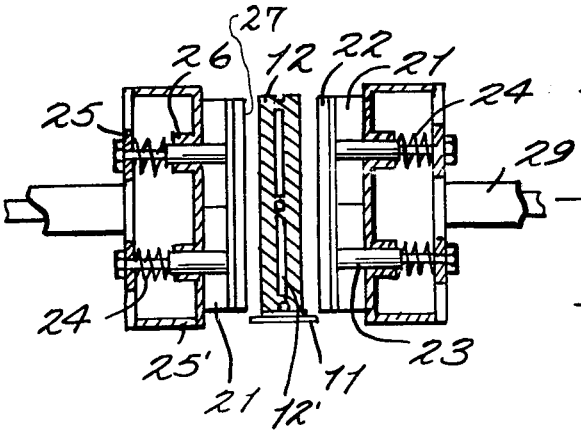
FIG. 3 is a detail cross-sectional view taken along lines 3—3 of FIG. 1 showing the punching tools and holders of the present invention.

The means for forming the tiles in ornamental shapes is shown generally at 20 in FIG. 1. Punching tools 21 are disposed on either side of the clay column 12 as it is moved by the conveyor 11. The punching tools 21 are constructed with any desired shape and are interchangeable, and punch out tiles corresponding to the shape of the tools. A tool 21 is provided on each side of the column 12 since the column is grooved (12′ — see FIG. 3) and one set of tiles can be made from each face of the column. The punching tools 21 are moved perpendicular to the faces of the clay column 12 and thus perpendicular to the direction of movement of the column and each penetrates adjustably up to a certain depth necessary for subsequent cleavage — such as to the groove 12′ at approximately the middle of the column 12. When the column is later severed (along the direction of the length of a groove 12′ therein, or along scores in the top or bottom thereof), one set of tiles will be formed by each face of the column 12.

Located adjacent to the punching tools 21 are holders 22 for holding the column gently in place while it is acted upon by the punching tools. It is to be understood that depending upon the shape of the punching tools 21, the holders 22 may be disposed at any locations relative to the tools 21 — such as completely around the punching edges of the tools 21 — so long as they properly perform their function of holding the column 12 while it is acted upon by the tools 21 without interfering with the operation of the tools 21. Each holder 22 is mounted on a rod 23 extending through supporting plate 25 and mounting means 25′ for tool 21, and is guided by guide 26. The holders 22 are spring-pressed by springs 24 so that the clay column 12 may be held firmly but without distortion, deformation, or breakage when acted upon by the tools 21. Preferably, the face 27 of each holder 22 is formed of a porous material — such as felt — which is saturated with oil. The oil on the felt helps prevent the holders 22 from sticking to the somewhat tacky clay column 12 and lubricates the tools 21 as they reciprocate between the holders 22 so that they will not stick to the column 12.

Each plate 25 and mounting means 25' to which a punching tool 21 is affixed is in turn affixed to one end of the reciprocating guide rods 29. The guide rods 29 pass through guides 30 rigidly affixed to a movable carriage 50 as will be more fully explained, and are affixed at the opposite ends thereof to a follower member 38. The member 38 is acted upon by a roller 32 attached to a lever 34 which in turn is attached to a rotatable vertically disposed shaft 36. The engagement of roller 32 with follower 38 illustrated in FIG. 1 allows the ornamental tile forming assembly 20 to be movable while the means 40 for actuating it (as will be further described) remains stationary. Rotary oscillation of the shaft 36 results in arcuate oscillation of the roller 32 which is, in turn, transformed into reciprocatory movement of the rods 29 and the tools 21.

Also attached to each plate 25 is a cutting wire 29'; the wires 29' acting together completely sever the section of the column 12 which has been acted upon the assembly 20 from the rest of the column.

Figure 2:
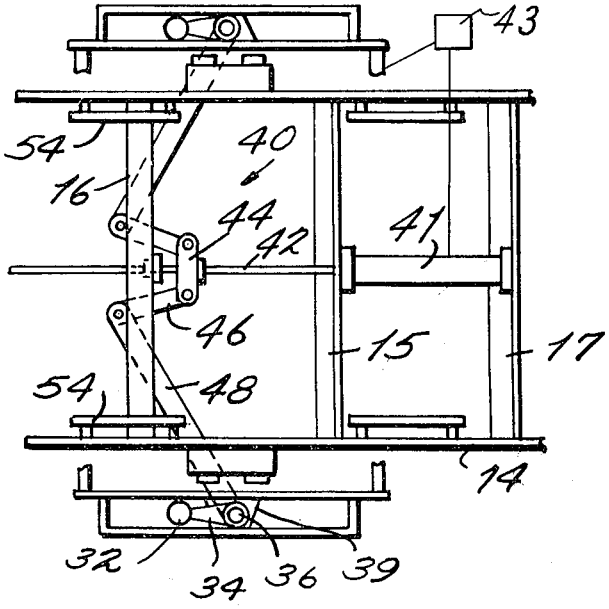
FIG. 2 is a top plan view of the apparatus shown in FIG. 1 with portions cut away to clearly show the drive means for operating the punching tools.

An exemplary drive means for oscillating the vertical shaft 36 is shown generally at 40 in FIG. 2. The force for the drive may be supplied by a fluid-actuated piston assembly 41 supported on cross-members 15 and 17 of the frame 14. The piston assembly acts upon a rod 42 which is rigidly connected to a member 44. Pivoted to each end of the member 44 is a lever 46, which is in turn pivotally connected to a lever 48. Each lever 48 is rigidly attached to a shaft 36 so that oscillation of a lever 48 results in corresponding movement of its corresponding shaft 36.

The piston assembly 41 may be itself actuated by fluid pressure selectively applied to it through fluid lines. As the carriage 50 — as will be further described — reciprocates, it actuates a valve 43 which supplies pressure to the piston of the piston assembly 41 to move the punching tools 21 into operative engagement with the clay column 12. After the punching operation is completed, as the carriage moves further along its path it will close the valve thereby moving the piston of the piston assembly 41 and the punching tools 21 back to their original positions.

As mentioned above, the whole assembly 20 is mounted by guides 30 to a movable carriage 50. The carriage 50 has rollers 52 attached thereto for allowing guided oscillating reciprocatory movement of the carriage 50 parallel to the direction of movement of the clay column 12. The rollers are mounted on roller guide rails 54, and movement of the carriage 50 is effected by a conventional drive means 60. The drive means 60 moves the carriage 50 and the ornamental tile forming assembly 20 connected thereto at about the same speed as the conveyor 11 so that there will be no relative movement between the column 12 and the punching tools 21 when they are brought into contact with each other — this of course insures proper feed by the conveyor 11 and prevents damage to the tiles that are formed and interference with the operation of the extrusion press.

Figure 5A:
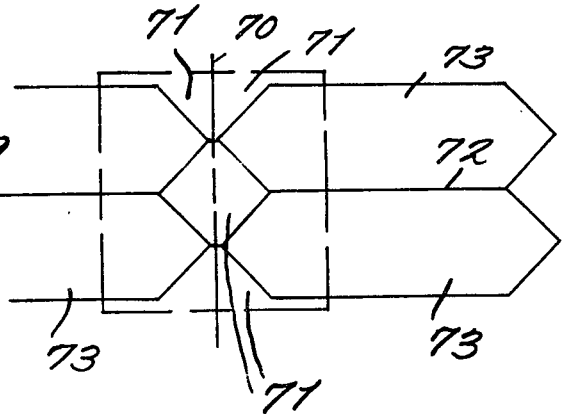
FIGS. 5*a* and 5*b* are diagrammatic views illustrating various ornamental tiles that may be formed according to the teachings of the present invention.
Figure 4:
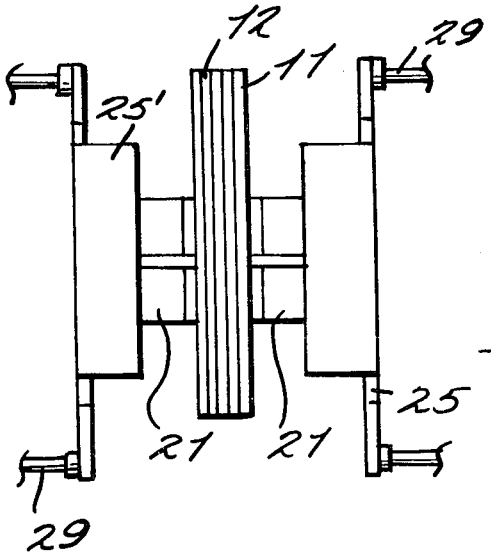
FIG. 4 is a detail top plan view of an exemplary form of the punching tools and supports therefor with the holders cut away.
Figure 5B:
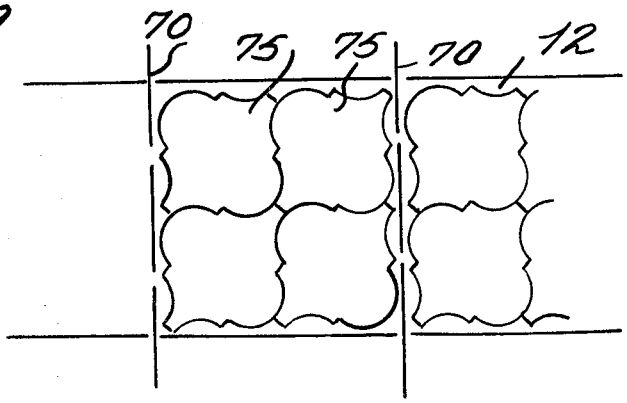

FIGS. 5*a* and 5*b* show various ornamental tiles that may be formed according to the teachings of the present invention. The lines 70 indicate where the cutting wires 29' sever the column 12 as it is acted upon by the assembly 20. In FIG. 5*a*, pointed plates 73 are formed by merely punching out sections 71 at each end of the plates, while the upper and lower surfaces of the plates are formed by the original top and bottom of the clay column 12. The plates 73 may also be severed lengthwise along line 72 by the punching tools 21. In FIG. 5*b*, intricately designed tiles 75 are formed. The punching tools are so shaped that they punch out four tiles 75 from each face of the column 12 so that — after cleavage along the direction of the length of the groove 12' — 8 will be formed during each punching operation, with very little waste.

The apparatus according to the teachings of the present invention having been described, its operation will now be set forth. A continuous upright clay column 12 is carried by the conveyor 11 from an extrusion press to the tile forming assembly 20. The assembly 20 for forming ornamental tiles is attached to a movable carriage 50 which is driven by conventional drive means 60 at approximately the same speed as the conveyor 11. As the carriage 50 is moved in the direction of movement of the column 12, it actuates a control valve (not shown) which supplies fluid under pressure to piston assembly 41. Piston assembly 41 then reciprocates piston rod 42, which pivots levers 46 and 48, which in turn oscillate each vertical shaft 36. Shaft 36 in turn oscillates lever 34, which moves roller 32, thereby reciprocating follower member 38 and punching tool 21 perpendicular to the direction of movement of the conveyor 11. Holders 22 are brought into engagement with the column 12 along with each punching tool 21 to firmly hold the column 12 while each tool 21 passes through the face of the column 12 to approximately the middle of the column. Cutting wires 29' also are brought into engagement with the column 12 and completely sever it at its most rearward point in the assembly 20. After the punching is completed, as carriage 50 further reciprocates in the direction of movement of conveyor 11, it closes the control valve 43 thereby cutting off or reversing the fluid supply to piston assembly 41, moving rod 42 back to its original position and the punching tools 21 out of engagement with the column 12. Then the drive means 60 moves the carriage 50 opposite to the direction of movement of the conveyor 11 back to its original position, whereupon the whole cycle may be performed again. The column section acted upon by the tile forming assembly 20 that has been severed from the rest of the column 12 may then be dried, fired and severed along the direction of the length of the groove 12' to form finished ornamental tiles.

Although the invention has been herein shown and described in what is presently conceived to be the most practical and preferred embodiment, it is recognized that departures may be made therefrom within the scope of the invention — which is not to be limited to the details disclosed, but is to be accorded the full scope of the claims so as to embrace any and all equivalent structures and devices.

What I claim is:

1. Apparatus for producing ornamentally shaped tiles comprising a. means for conveying a continuous clay column in an upright position from an extrusion press, b. punching means movable through a side face of said column to a predetermined depth perpendicular to the direction of conveyance of said column, c. means for moving said punching means perpendicular to the direction of conveyance of said column, d. cutting means for severing a section of said continuous column acted upon by said punching means from the rest of said column, and e. means for moving said punching and cutting means with substantially the same velocity as the velocity of conveyance of said column so that there is no relative movement between said punching means and said column while said punching means acts on said column.

2. Apparatus as recited in claim 1 wherein said means for moving said punching and cutting means comprises a movable carriage reciprocal in a direction parallel to the direction of conveyance of said column, and a drive means for moving said carriage.

3. Apparatus as recited in claim 2 wherein said means for moving said punching means perpendicular to the side faces of said column includes a fluid-actuated piston assembly.

4. Apparatus as recited in claim 3 wherein said means for moving said punching means perpendicular to a side face of said column further includes control valve means actuatable by said carriage for actuating said piston assembly when said carriage moves in the same direction as the direction of conveyance of said column, and for returning said piston assembly to its original position after completion of the punching operation.

5. Apparatus as recited in claim 4 wherein said means for moving said punching means perpendicular to the side faces of said column further includes a shaft rotatable about an axis perpendicular to the direction of movement of said column, a lever system operatively connected from said piston assembly to said shaft, and a roller and follower system operatively connected from said shaft to said punching means.

6. Apparatus as recited in claim 1 wherein said means for moving said punching means perpendicular to a side face of said column does not move with said punching means when said punching means moves with substantially the same velocity as said column.

7. Apparatus as recited in claim 1 further comprising holding means for holding said column firmly but without breakage or deformation while being acted upon by said punching means.

8. Apparatus as recited in claim 7 wherein said holding means includes spring-biased members movable with said punching means into engagement with the side faces of said column.

9. Apparatus as recited in claim 8 further comprising means associated with said holding means for assisting in preventing said holding members and said punching means from sticking to said clay column after acting thereon.

10. Apparatus as recited in claim 1 wherein said column has a groove in the middle thereof throughout the length thereof, and wherein said punching means includes means movable through each side face of said column to approximately said groove in the middle thereof.

* * * * *